US008454483B1

(12) United States Patent
Bradley et al.

(10) Patent No.: US 8,454,483 B1
(45) Date of Patent: Jun. 4, 2013

(54) CONFIGURABLE EXERCISE SYSTEM

(75) Inventors: Christopher Michael Bradley, Orinda, CA (US); Alan Scott Crarer, Pacifica, CA (US); Jeffrey Alan Tilley, La Honda, CA (US)

(73) Assignee: 2nd Edison, Inc., Orinda, CA (US)

( * ) Notice: Subject to any disclaimer, the term of this patent is extended or adjusted under 35 U.S.C. 154(b) by 647 days.

(21) Appl. No.: 11/973,719

(22) Filed: Oct. 9, 2007

(51) Int. Cl.
*A63B 21/00* (2006.01)

(52) U.S. Cl.
USPC ..... 482/92; 482/44; 482/45

(58) Field of Classification Search
USPC ..... 482/44, 45, 50, 68, 92, 93, 104, 106, 482/107, 108, 131, 141, 910; 473/256; D21/680, 686
See application file for complete search history.

(56) References Cited

U.S. PATENT DOCUMENTS

| | | | | |
|---|---|---|---|---|
| 777,478 | A * | 12/1904 | Minor | 482/93 |
| 1,316,683 | A * | 9/1919 | Calvert | 482/93 |
| 4,801,140 | A * | 1/1989 | Bergeron | 482/146 |
| 5,286,020 | A * | 2/1994 | Caruso | 473/603 |
| 6,387,022 | B1 * | 5/2002 | Smith | 482/106 |
| 6,629,908 | B2 * | 10/2003 | Hamady | 482/45 |
| 7,052,445 | B2 * | 5/2006 | Ekhaus | 482/93 |
| 7,175,573 | B1 * | 2/2007 | Huang | 482/110 |
| 7,381,157 | B2 * | 6/2008 | Blateri | 482/50 |

* cited by examiner

*Primary Examiner* — Glenn Richman

(57) ABSTRACT

A configurable exercise system which may be transformed into multiple pieces of exercise equipment is disclosed. More specifically, embodiments provide an adjustable-weight medicine ball with two halves that may be separated and used to implement dumbbells, kettlebells, push-up bars, or other pieces of exercise equipment. Each half of the medicine ball may have a handle and/or features for accepting one or more weighted objects for varying the weight of each half. Additional components may be joined to one or both halves of the medicine ball to implement other pieces of exercise equipment. Additionally, components may be inserted between the halves of the medicine ball to implement other pieces of exercise equipment. Further, in one embodiment, the exercise system may be easily and quickly transformed, compact in size, and relatively low-cost.

25 Claims, 17 Drawing Sheets

120

120

120

120

120

900

1100

1100

CONFIGURABLE EXERCISE SYSTEM

BACKGROUND OF THE INVENTION

As gyms become more expensive and crowded, more and more people are beginning to exercise at home. For example, dumbbells, medicine balls, kettlebells, push-up bars, and other exercise equipment may be purchased and used to exercise in the comfort of one's own home. Additionally, most types of exercise equipment can be purchased in many different weights or sizes, thereby enabling the selection of a specific piece of equipment for a specific workout need. Thus, most home gyms include multiple sets of dumbbells, multiple medicine balls, multiple kettlebells, and various other pieces of exercise equipment.

Given that each piece of conventional exercise equipment is relatively expensive, the cost of the numerous pieces of conventional exercise equipment in a typical home gym is high. For example, several sets of dumbbells, several medicine balls, and a set of push-up bars can easily exceed $500.

In addition to high cost, conventional exercise equipment also occupies a large space and is difficult to store discretely. For example, the irregular size and shape of many types of exercise equipment make them hard to stack and store neatly. As such, exercise equipment is commonly strewn across the floor of a workout room or bedroom, which reduces the floor space available for performing exercises. Further, even if the numerous pieces of exercise equipment are piled on top of one another, it is difficult and time-consuming to select and remove a piece of exercise equipment from the pile.

SUMMARY OF THE INVENTION

Accordingly, a need exists for an exercise system which enables the performance of various exercises at reduced cost. A need also exists for an exercise system which occupies a relatively small amount of floor space when not in use. Additionally, a need exists for exercise equipment which may be selected and prepared for use easily and quickly. Further, a need exists for an exercise system which can be stored discretely when not in use. Embodiments of the present invention provide novel solutions to these needs and others as described below.

Embodiments are directed to a configurable exercise system which may be transformed into multiple pieces of exercise equipment. More specifically, embodiments provide an adjustable-weight medicine ball with two halves that may be separated and used to implement dumbbells, kettlebells, push-up bars, or other pieces of exercise equipment. Each half of the medicine ball may have a handle and/or features for accepting one or more weighted objects for varying the weight of each half. Additional components may be joined to one or both halves of the medicine ball to implement other pieces of exercise equipment (e.g., rotational push-up bars using a lazy-susan attachment, sliding handgrips using an attachment with a low coefficient of friction, handles for an elastic band using an attachment with a mechanism for grasping the elastic band, etc.). Additionally, components may be inserted between the halves of the medicine ball to implement other pieces of exercise equipment (e.g., a rolling device with handles used for abdominal exercise, etc.). Further, in one embodiment, the exercise system may be easily and quickly transformed, compact in size, and relatively low-cost.

In one embodiment, a configurable exercise system includes a spherical-shaped housing operable to implement a first piece of workout equipment, the housing including a first portion and a second portion operable to interface and physically couple with the first portion. The first and second portions are operable to be disengaged from one another to implement at least one additional piece of workout equipment. Additionally, the configurable exercise system may further include at least one object operable to be secured to the housing, the at least one object for adjusting the weight of the housing when disposed within the housing. The first portion and the second portion may each include at least one feature for securing the at least one object. Additionally, each portion may include a handle in one embodiment. Further, the first piece of workout equipment may implement a medicine ball, and wherein the at least one additional piece of workout equipment is selected from a group consisting of at least one dumbbell, at least one kettlebell, at least one push-up bar, at least one rotational push-up bar, at least one weight for a barbell, at least one handle for an elastic band, and at least one sliding handgrip.

In another embodiment, a workout apparatus includes a housing including at least one handle, wherein the housing resembles a hemi-sphere. An additional component is physically coupled to the housing for enabling the housing to implement different exercise equipment. The additional component may include a rotating surface operable to rotate independently of the housing, and wherein the housing and additional component may implement a rotational push-up bar for enabling the performance of push-ups and additional exercises using the handle of the housing. Alternatively, the additional component may include a rotating surface operable to rotate independently of the housing, and wherein the housing and additional component may implement a rotational push-up bar for enabling the performance of push-ups and additional exercises using the handle of the housing. The additional component may include a mechanism for mechanically coupling the housing to an elastic band, and wherein the housing and the additional component may implement a handle for the elastic band for enabling the performance of exercises using the elastic band. Alternatively, the additional component may be selected from a group consisting of a pillow and a ball-shaped surface. The additional component may include a surface for sliding over the external surface, and wherein the housing and additional component may implement a sliding handgrip for enabling the performance of exercises using the handle of the housing.

In yet another embodiment, an exercise apparatus includes a spherical-shaped housing including two hemi-spherical components, wherein each hemi-spherical component includes a respective handle. The exercise apparatus also includes a circular portion operable to rotate with respect to the housing, the circular portion for rotating independently of the at least one handle, and the circular portion further for enabling the housing to move across a surface when pushed using the at least one handle. The hemi-spherical components may be operable to disengage from the housing. The hemi-spherical components may be operable to accept at least one object for adjusting the weight of the housing.

And in yet another embodiment, a retail package includes an adjustable-weight medicine ball. The adjustable-weight medicine ball includes a spherical-shaped housing and at least one object for adjusting the weight of the adjustable-weight medicine ball when disposed within the housing. The retail package also includes a container for housing the adjustable-weight medicine ball, the container comprising at least one surface for presenting information about the adjustable-weight medicine ball. Literature (e.g., a manual for the adjustable-weight medicine ball) comprising information about the adjustable-weight medicine ball may also be included. The retail package may also include a video with information about the adjustable-weight medicine ball. The container may include an opening for enabling interaction with the adjustable-weight medicine ball. Additionally, the container may include a window for viewing the adjustable-weight medicine ball and the at least one object for adjusting the weight of the adjustable-weight medicine ball.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION OF THE INVENTION

Reference will now be made in detail to embodiments of the present invention, examples of which are illustrated in the accompanying drawings. While the present invention will be discussed in conjunction with the following embodiments, it will be understood that they are not intended to limit the present invention to these embodiments alone. On the contrary, the present invention is intended to cover alternatives, modifications, and equivalents which may be included with the spirit and scope of the present invention as defined by the appended claims. Furthermore, in the following detailed description of the present invention, numerous specific details are set forth in order to provide a thorough understanding of the present invention. However, embodiments of the present invention may be practiced without these specific details. In other instances, well-known methods, procedures, components, and circuits have not been described in detail so as not to unnecessarily obscure aspects of the present invention.

Figure 1:
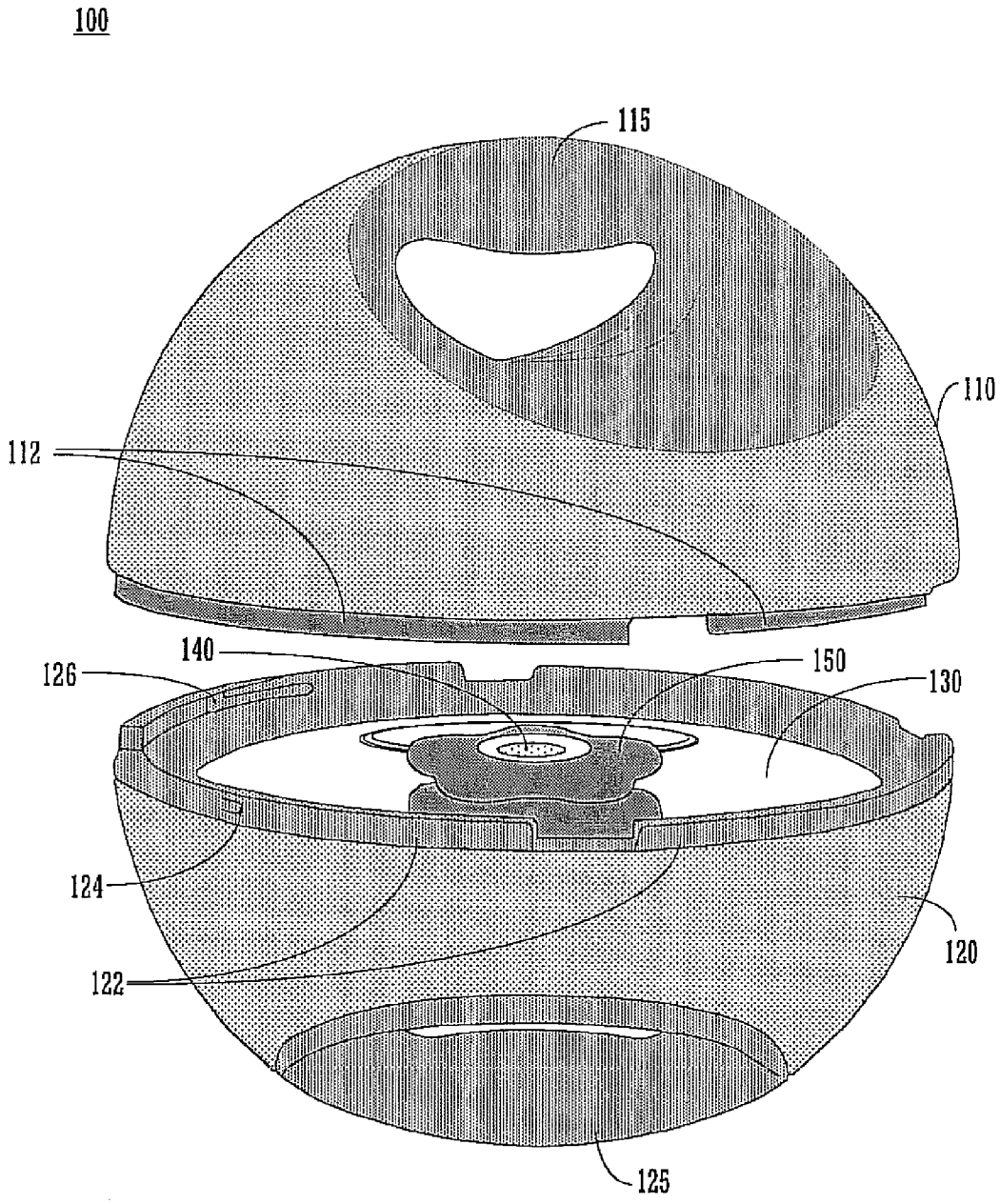
FIG. 1 shows an exemplary configurable exercise system in accordance with one embodiment of the present invention.

FIG. 1 shows exemplary configurable exercise system 100 in accordance with one embodiment of the present invention. As shown in FIG. 1, configurable exercise system 100 comprises portion 110 and portion 120, where each portion may comprise a respective handle (e.g., 115 and 125). Each handle may be formed or molded into each portion as shown in FIG. 1, or alternatively, may be otherwise attached in other embodiments. Additionally, each portion may comprise engagement features 112 and 122 for engaging the other portion and/or one or more other objects. Accordingly, portions 110 and 120 may be physically engaged to form a unified piece of exercise equipment (e.g., a spherically-shaped object, a medicine ball as discussed below with respect to FIG. 2, etc.) or disengaged and used as individual pieces of exercise equipment (e.g., dumbbells, kettlebells, push-up bars, etc. as discussed below with respect to FIG. 3).

Additionally, portion 110 and/or portion 120 may comprise at least one feature for securing removable weighted objects to a respective portion (e.g., 110 and/or 120). For example, weighted object 130 may comprise threads for interfacing with threads of threaded rod 140, thereby enabling the weighted objects (e.g., 130) to be turned with respect to threaded rod 140 for easy installation and removal. In other embodiments, weighted object 130 may be placed on threaded rod 140 and secured by one or more fastening members (e.g., nut 150, another weighted object with threads for interfacing with threaded rod 140, spring clips, pins, etc.) operable to be physically coupled to threaded rod 140. Although not shown in FIG. 1, portion 110 may also comprise features (e.g., a threaded rod similar to threaded rod 140, etc.) for securing weighted objects to portion 110.

As shown in FIG. 1, weighted object 130 may comprise a weight plate, a shot-filled object, a sand-filled object, a water-filled object, a metal object, etc. One or more weighted objects may be secured to portion 110 and/or portion 120 to vary the weight of system 100. Additionally, the weight of each portion may be varied to implement multiple pieces of exercise equipment (e.g., an adjustable-weight medicine ball when portions 110 and 120 are engaged, adjustable-weight dumbbells when portions 110 and 120 are disengaged, etc.).

Portions 110 and 120 may comprise a molded plastic housing in one embodiment. The housing may form a cavity for accepting weighted objects (e.g., 130) for varying the weight of the respective portion and/or system 100 when portions 110 and 120 are engaged. The housing may also comprise provisions (e.g., as discussed below with respect to FIGS. 6A-7B) for attaching engagement features (e.g., threaded rod 140, a fastening material for engaging or gripping weighted objects, etc.) which are operable to secure the weighted objects to each respective portion. Additionally, in one embodiment, the housing of portion 110 and/or portion 120 may comprise a more rigid material (e.g., polycarbonate, acrylonitrile butadiene styrene, polyethylene, etc.) while the outside surface of portion 110 and/or portion 120 may comprise a rubber (e.g., applied to the housing as a co-mold) to increase grip on system 100, to make system 100 more comfortable to handle (e.g., when passed as a medicine ball), to increase the durability of system 100, etc. In other embodiments, the housing of system 100 and/or the outside surface of system 100 may comprise other materials (e.g., metal, wood, etc.).

Engagement features 112 and/or 122 may comprise hermaphroditic engagement features in one embodiment. For example, portion 120 may comprise tab 124 for interfacing with a slot of portion 110 (e.g., not shown in FIG. 1 but similar to slot 126 of portion 120), and may also comprise slot 126 for interfacing with a tab of portion 110 (e.g., not shown in FIG. 1 but similar to tab 124 of portion 120). As such, corresponding tabs and slots may be interfaced by bringing portions 110 and 120 together and twisting one portion with respect to another, where the twisting may also serve to lock or secure the engagement of the two portions (e.g., 110 and 120). And in other embodiments, portions 110 and 120 may comprise other types of features for engaging the two portions together.

Portions 110 and 120 may be identical or substantially identical in one embodiment. For example, portion 110 and 120 may be created from the same mold or molds. Additionally, engagement features 112 and 122 may also be identical or substantially identical. As such, embodiments can reduce design and manufacturing costs by utilizing the same mold or molds to create portions 110 and 120.

As shown in FIG. 1, portion 110 and/or portion 120 may comprise at least one compartment or bladder (e.g., sealed, vented, etc.). For example, the at least one bladder may be coupled to an frame (e.g., injection-molded frame, sheet metal frame, etc.) disposed beneath the bladder. Alternatively, the bladder may be formed as part of portion 110 and/or portion 120 using blow-molding or other processes. Additionally, the bladder may be filled with air (e.g., using a pump via an air inlet valve similar to a basketball, during manufacturing, etc.), thereby enabling portion 110 and/or portion 120 (e.g., when combined into a medicine ball, when used separately, etc.) to be bounced, passed from one person to another, etc. Further, it should be appreciated that the at least one bladder may be filled with other materials (e.g., water, sand, etc.) to add weight, change physical properties of system 100 (e.g., to make the ball bounce, to change the system's deformation, etc.), etc. In this manner, system 100 (e.g., portion 110, portion 120, etc.) may comprise an inflatable workout apparatus (e.g., inflatable medicine ball, inflatable dumbbell, inflatable kettlebell, etc.).

In one embodiment, portion 110 and/or portion 120 may comprise a fixed weight and be colored according to a respective weight of each portion. For example, portion 110 may comprise a weight of 10 pounds and a housing which is blue in color, while portion 120 may comprise a weight of 15 pounds and a housing which is black in color. In other embodiments, each portion may comprise different weights and/or colors, where each portion (e.g., 110, 120, etc.) may comprise similar or different weights. In this manner, portion 110 and 120 may be engaged to implement a fixed-weight medicine ball, and also disengaged to implement fixed-weight dumbbells, fixed-weight kettlebells, fixed-weight push-up bars, etc.

Figure 2:
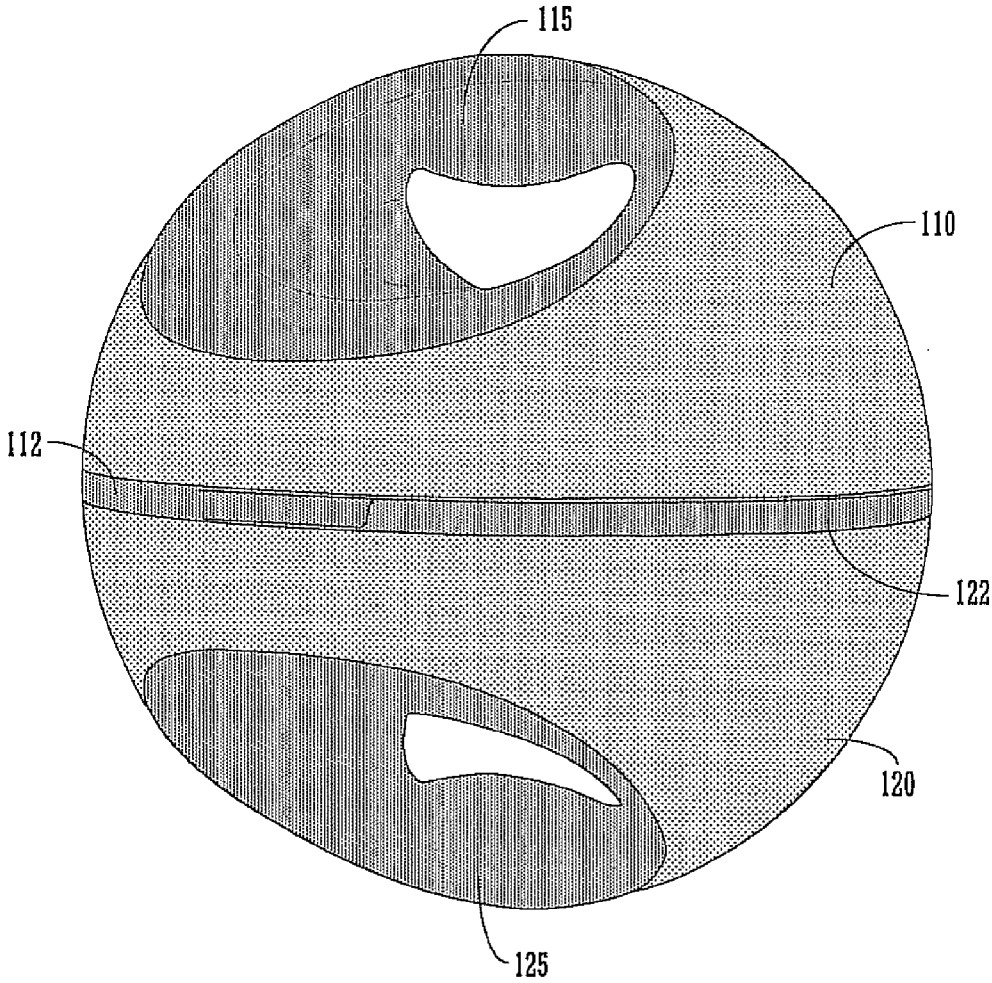
FIG. 2 shows an exemplary configurable exercise system with portions in a physically engaged state in accordance with one embodiment of the present invention.

FIG. 2 shows exemplary configurable exercise system 100 with portions 110 and 120 in a physically engaged state in accordance with one embodiment of the present invention. As shown in FIG. 2, portions 110 and 120 are brought together such that engagement features 112 and 122 interface. Additionally, engagement features 112 and 122 may lock or secure the portions together (e.g., using tabs similar to tab 124 and slots similar to slot 126, other locking engagement features, etc.) when portions 110 and 120 are twisted with respect to one another after being brought together. In this manner, portions 110 and 120 may implement a spherical medicine ball with handles in one embodiment, where each portion resembles a hemi-sphere with a handle (e.g., 115, 125, etc.) for grabbing system 100 and/or each respective portion.

Using system 100 in an engaged state as depicted in FIG. 2, various exercises or workout routines targeting one or more portions of the body may be performed. For example, exercises targeting the abdominal muscles (e.g., wood chops, roman twists, lunges, squats, etc.), bun or butt muscles (e.g., lunges, squats, etc.), leg muscles (e.g., lunges, squats, etc.), multiple muscle groups of the body (e.g., wood chops, etc.), or the like, may be performed using system 100 (e.g., grasping handle 115 and/or handle 125, grasping the outside surface of system 100, etc.). Additionally, one or more resistance and/or cardio exercises may be performed using system 100. Further, system 100 may be used in conjunction with other pieces of equipment to perform other exercises (e.g., step-ups using a stair or bench, other exercises using a swiss ball, etc.). And in other embodiments, the weight of system 100 may be varied by adding or removing weighted objects (e.g., disposed within the housing of system 110 and secured to portion 110 and/or portion 120) from system 100, thereby enabling system 100 to implement various pieces of exercise equipment (e.g., various weight medicine balls) in an engaged state as depicted in FIG. 2.

Figure 3:
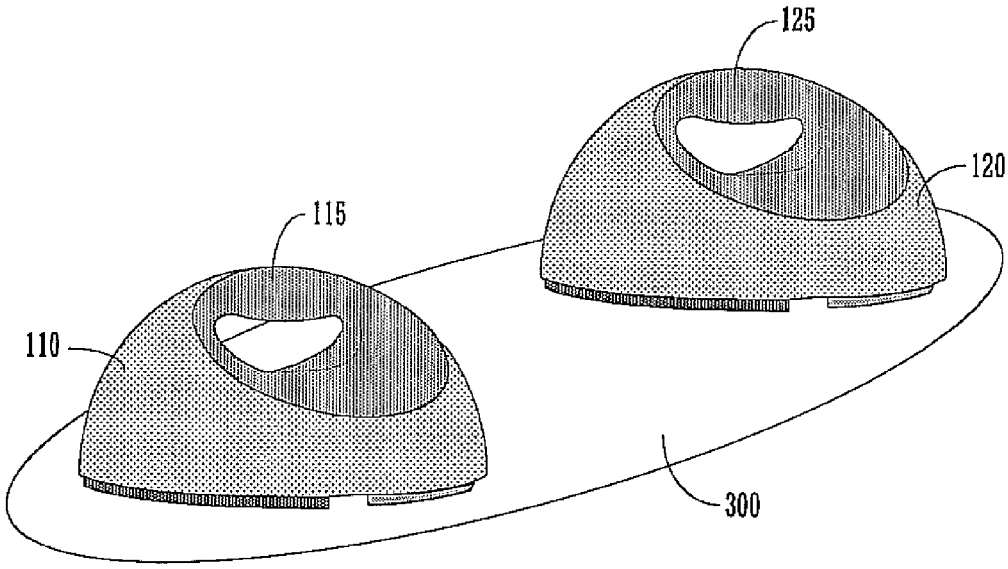
FIG. 3 shows an exemplary configurable exercise system with portions in a disengaged state in accordance with one embodiment of the present invention.

FIG. 3 shows exemplary configurable exercise system 100 with portions 110 and 120 in a disengaged state in accordance with one embodiment of the present invention. As shown in FIG. 3, portion 110 and/or portion 120 may implement a dumbbell, a kettlebell, a push-up bar, a weight for a barbell (e.g., by inserting an end of the barbell into handle 115 and/or 125, by inserting an end of the barbell into an object attached to portion 110 and/or portion 120, etc.), etc. As such, portions 110 and 120 may be used to perform many different types of exercises targeting one or more portions of the body. Exercises may be performed using portions 110 and 120 alone (e.g., manipulated in mid-air, placed on surface 300 and used to lift or move at least one portion of the body, etc.), using portions 110 and 120 in conjunction with other equipment, or the like. Additionally, portions 110 and 120 may be used to perform exercises by gripping handle 115 and/or 125 directly, by gripping another object (e.g., barbell, etc.) to which portion 110 and/or portion 120 are attached, etc. Further, the weight of portion 110 and/or portion 120 may be varied (e.g., by adding or removing weighted objects from a respective portion), thereby enabling the portions (e.g., 110, 120, etc.) to implement various pieces of exercise equipment (e.g., various weight medicine balls) in a disengaged state as depicted in FIG. 3.

Portion 110 and 120 may also be stored in a disengaged state as depicted in FIG. 3. In this manner, the height of each portion may be approximately half the height or diameter of system 100, thereby enabling system 100 to be stored in more compact places (e.g., under a bed or couch, on a shelf in a cabinet, etc.). Additionally, the weighted objects (e.g., 130) used to adjust the weight of system 100 may be stored within each portion (e.g., 110, 120, etc.). Accordingly, system 100 may be stored more discretely than conventional exercise equipment, and may also occupy less floor space than conventional exercise equipment when not in use.

Figure 4A:
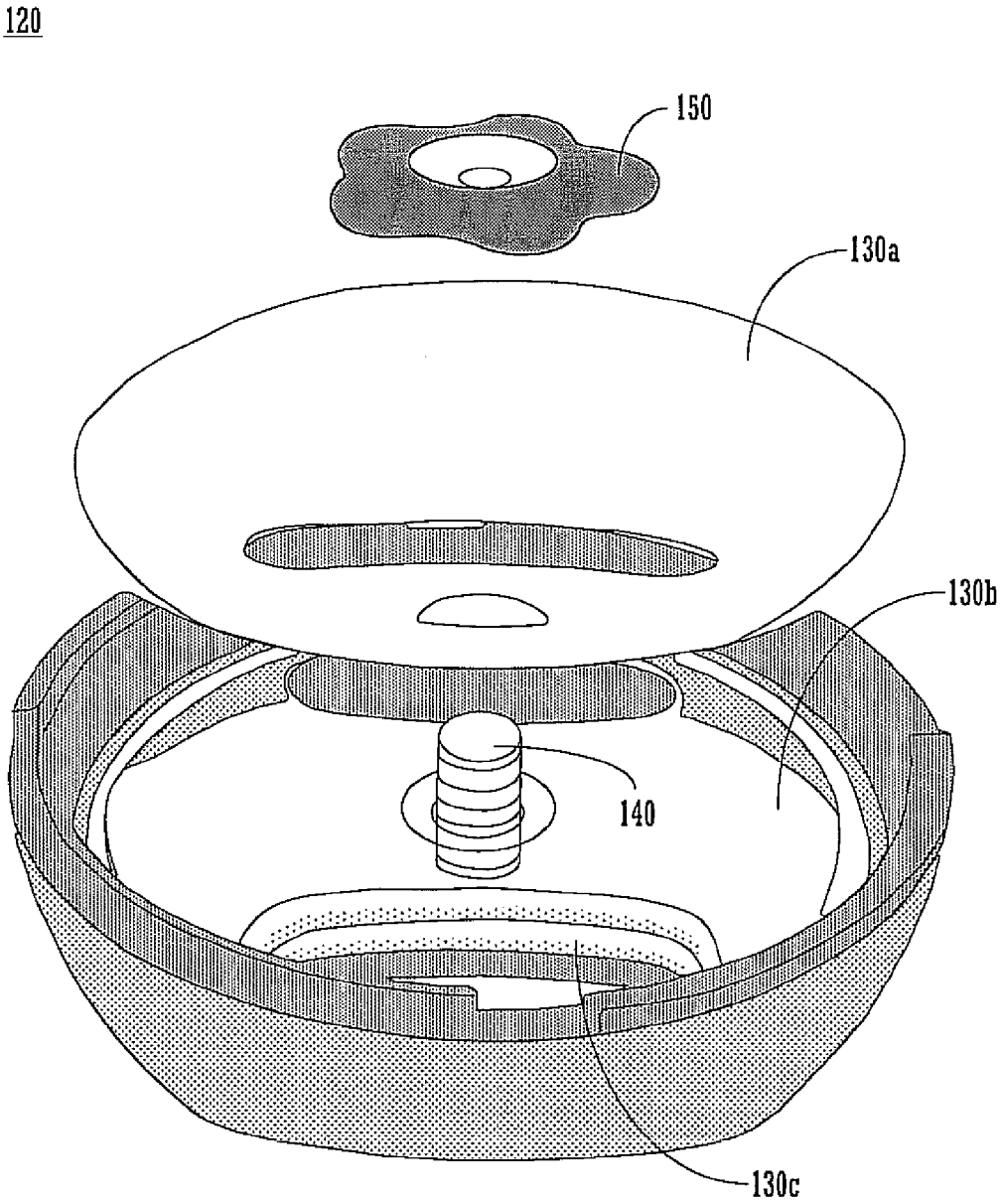
FIG. 4A shows exemplary weighted objects to be secured in a portion of a configurable exercise system in accordance with one embodiment of the present invention.
Figure 4B:
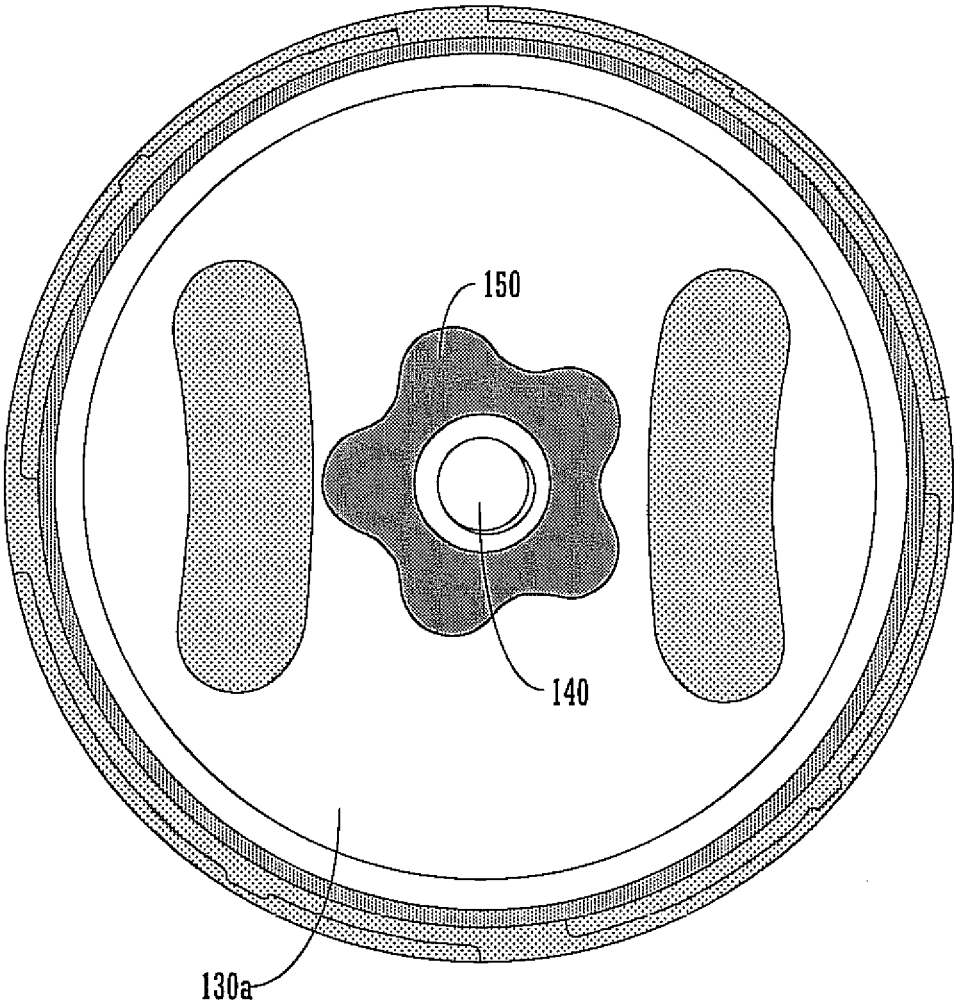
FIG. 4B shows exemplary weighted objects secured within a portion of a configurable exercise system in accordance with one embodiment of the present invention.

FIGS. 4A and 4B show the securing of exemplary weighted objects to portion 120 in accordance with one embodiment of the present invention. As shown in FIG. 4A, various weighted objects 130*a*-130*c* may be placed within a cavity of portion 120 and located by threaded rod 140. It should be appreciated that one or more of weighted objects 130*a*-130*c*, either alone or in combination with each other, may implement weighted object 130 of FIG. 1.

After weighted objects 130*a*-130*c* have been placed on portion 120, nut 150 may be used to secure the weighted objects (e.g., 130*a*-130*c*) to portion 120. For example, nut 150 may be tightened against weighted object 130*a* to clamp the weighted objects (e.g., 130*a*-130*c*) between nut 150 and an inside surface (e.g., on which the bottom-most weight rests) of portion 120. One or more of weighted objects 130*a*-130*c* may be removed from portion 120 by removing nut 150 and then removing one or more weighted objects. Accordingly, embodiments enable quick and easy addition and/or removal of weighted objects (e.g., 130*a*-130*c*) from portion 120. Further, although FIGS. 4A and 4B depict securing of weighted objects to portion 120, it should be appreciated that weighted objects may be similarly installed and/or removed from portion 110.

In one embodiment, portion 120 may implement multiple pieces of workout equipment by securing different combinations of weighted objects 130*a*-130*c* to portion 120. For example, the weight of portion 120 without any weighted objects may weigh 1 pound, weighted object 130*a* may weigh 1 pound, weighted object 130*b* may weigh 2 pounds, and weighted object 130*c* may weigh 3 pounds. Accordingly, as shown in Table 1 below, portion 120 may implement seven pieces of workout equipment, each with a different weight. It should be appreciated that different combinations of weighted objects 130*a*-130*c* may be used to form the same or similar weight of portion 120, and thus, the combinations of weighted objects 130*a*-130*c* listed in Table 1 are merely exemplary. Further, it should be appreciated that weighted objects similar to weighted objects 130*a*-130*c* may be secured to portion 110, thereby enabling system 100 to implement 13 pieces of workout equipment (e.g., with a total weight ranging from 2 lbs. to 14 lbs.) in one embodiment, each with a different weight.

TABLE 1

| Weights Applied to Portion 120 | Total Weight of Portion 120 (lbs) |
|---|---|
| None | 1 |
| 130a | 2 |
| 130b | 3 |
| 130a + 130b | 4 |
| 130a + 130c | 5 |
| 130b + 130c | 6 |
| 130a + 130b + 130c | 7 |

Figure 5A:
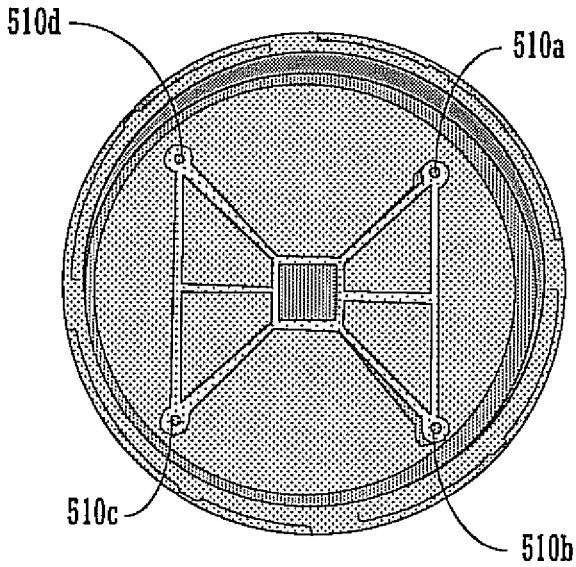
FIG. 5A shows an exemplary portion of a configurable exercise system for accepting a threaded rod protruding from, adhered to, or formed as part of a plate in accordance with one embodiment of the present invention.
Figure 5B:
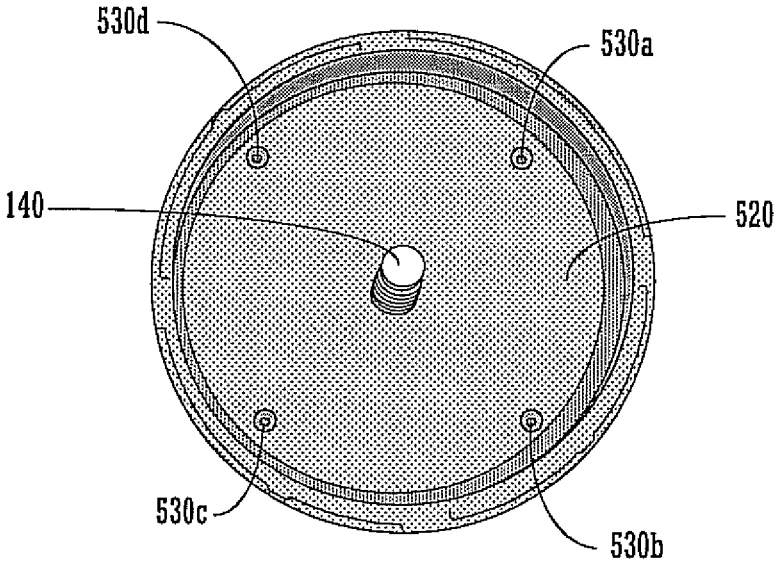
FIG. 5B shows an exemplary threaded rod protruding from, adhered to, or formed as part of a plate attached to a portion of the configurable exercise system in accordance with one embodiment of the present invention.

FIGS. 5A and 5B show exemplary threaded rod 140 protruding from, adhered to, or formed as part of plate 520 attached to portion 120 in accordance with one embodiment of the present invention. As shown in FIGS. 5A and 5B, threaded rod 140 may protrude from (e.g., through a hole in plate 520), be adhered to (e.g., glued, welded, etc.), or formed as part of plate 520, where plate and/or threaded rod 140 may comprise metal, plastic, a composite material, etc. Additionally, portion 120 comprises various mounting features 510*a*-510*d* for securing plate 520 to portion 120. Mounting features 510*a*-510*d* may comprise cavities into which screws may be threaded, for accepting threaded inserts (e.g., pressed into the cavities, ultrasonically welded into the cavities, etc.), etc. As such, plate 520 may be attached to portion 120 by passing screws through holes 530*a*-530*d* (e.g., engaging mounting features 510*a*-510*d*, engaging threaded inserts within mounting features 510*a*-510*d*, etc.), thereby mechanically coupling threaded rod 140 with portion 120.

Figure 6A:
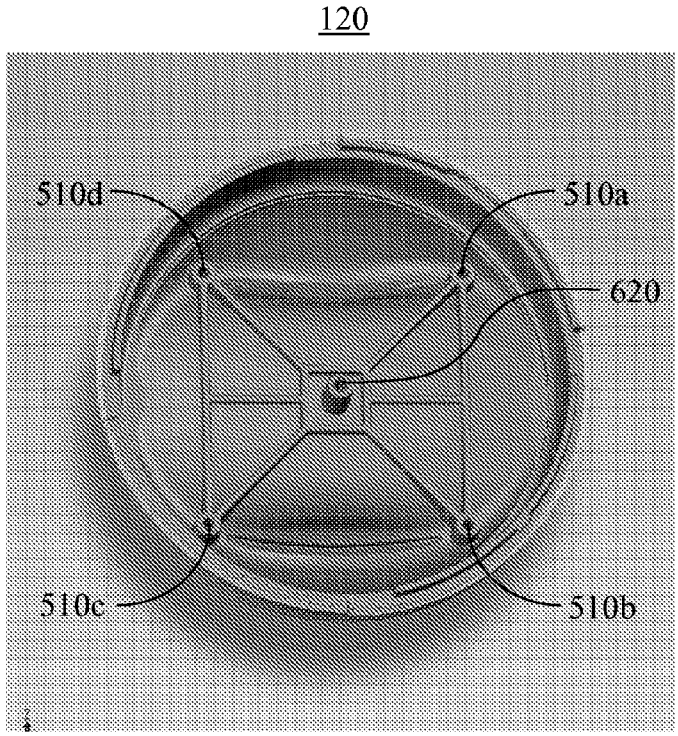
FIG. 6A shows an exemplary portion of a configurable exercise system for accepting a threaded rod physically coupled with a portion of the configurable exercise system using a screw in accordance with one embodiment of the present invention.
Figure 6B:
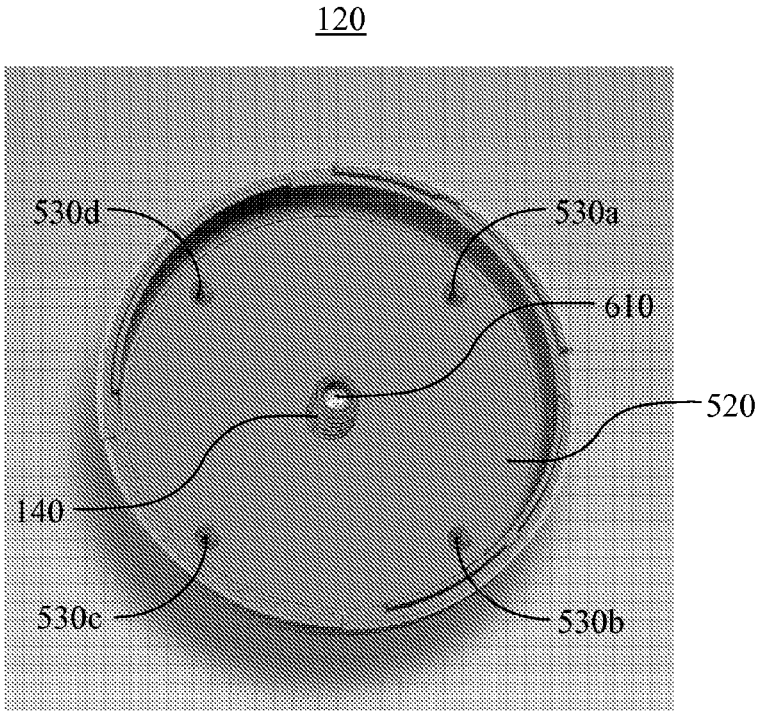
FIG. 6B shows an exemplary threaded rod physically coupled with a portion of the configurable exercise system using a screw in accordance with one embodiment of the present invention.

FIGS. 6A and 6B show exemplary threaded rod 140 physically coupled with portion 120 using screw 610 in accordance with one embodiment of the present invention. As shown in FIGS. 6A and 6B, screw 610 may attach threaded rod 140 directly to portion 120, where feature 620 in portion 120 may comprise a cavity into which screw 610 may be threaded, for accepting a threaded insert (e.g., pressed into the cavity, ultrasonically welded into the cavity, etc.) into which screw 610 may be inserted, etc. Alternatively, screw 610 may attach threaded rod 140 to plate 520 (e.g., using threads or a threaded insert in plate 520) such that screws passed through holes 530*a*-530*d* (e.g., and engaging mounting features 510*a*-510*d*, engaging threaded inserts within mounting features 510*a*-510*d*, etc.) may mechanically couple threaded rod 140 with portion 120.

Although FIGS. 1-6B discuss securing weighted objects (e.g., 130) to system 100 using a threaded rod (e.g., 140) and a nut (e.g., 150), it should be appreciated that other fastening means (e.g., Velcro® or other fastening material, clips attached to a respective portion, etc.) may be used in other embodiments. Additionally, although specific shapes, sizes, etc. have been used in FIGS. 1-6B for components of system 100 (e.g., portion 110, portion 120, weighted object 130, 130*a*-130*c*, etc.), it should be appreciated that one or more of the components may be alternatively shaped, sized, etc. in other embodiments. It should also be appreciated that system 100 may comprise a larger number of portions (e.g., in addition to portions 110 and 120) in other embodiments. Further, it should be appreciated that a smaller or larger number of weighted objects (e.g., 130, 130*a*-130*c*, etc.) may be used in other embodiments.

Figure 7A:
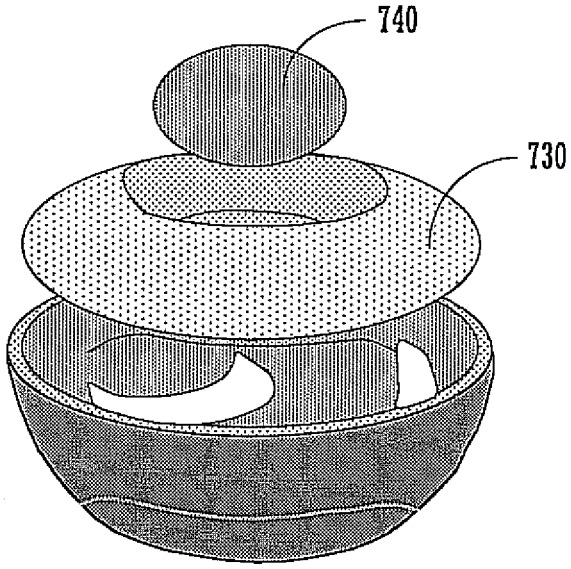
FIG. 7A shows an exploded view of an exemplary portion of a configurable exercise system with exemplary alternative weighted objects in accordance with one embodiment of the present invention.
Figure 7B:
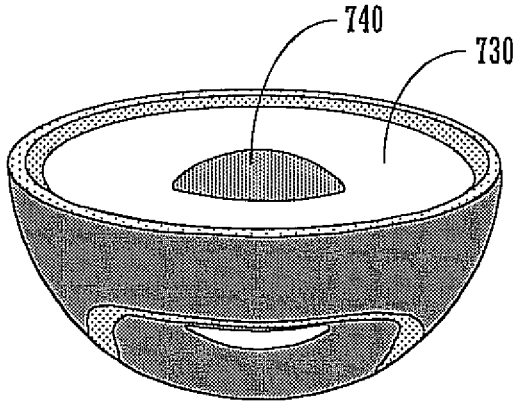
FIG. 7B shows an assembled view of an exemplary portion of a configurable exercise system with exemplary alternative weighted objects in accordance with one embodiment of the present invention.

FIGS. 7A and 7B show exemplary portion 120 of configurable exercise system 100 with exemplary alternative weighted objects in accordance with one embodiment of the present invention. As shown in FIGS. 7A and 7B, weighted objects 730 and 740 may be placed within portion 120 to vary the weight of portion 120 and/or system 100. In one embodiment, weighted object 730 may be donut-shaped and weighted object 740 may be spherically-shaped such that weighted object 740 may fit within weighted object 730. Weighted object 730 and/or weighted object 740 may comprise a skin (e.g., made of a plastic such as vinyl, made of cloth, etc.) capable of holding a filling material designed to add weight to the weighted object. For example, weighted object 730 and/or weighted object 740 may be filled with shot (e.g., lead shot, etc.), sand, water, solid metal, etc.

Weighted object 730 and/or weighted object 740 may be secured to portion 120 using a fastening material (e.g., Velcro®, etc.) in one embodiment. For example, the fastening material (not shown in FIGS. 7A and 7B) may be applied to a bottom surface of portion 120 (e.g., upon which weighted object 730 and/or weighted object 740 rest) and/or the weighted object (e.g., 730, 740, etc.) being secured. As such, weighted object 730 and/or weighted object 740 may be secured by merely placing and pressing the object against the interior surface of portion 120 in one embodiment. Alternatively, weighted object 730 and/or weighted object 740 may be secured by clamping the object to portion 120 (e.g., using a threaded rod and nut as discussed with respect to FIGS. 1-6B, etc.), secured using a clip attached to portion 120, or the like.

In one embodiment, portion 120 may implement multiple pieces of workout equipment by securing different combinations of weighted objects 730 and 740 to portion 120. For example, the weight of portion 120 without any weighted objects may weigh 3 pounds, weighted object 730 may weigh 5 pounds, and weighted object 740 may weigh 2 pounds. Accordingly, as shown in Table 2 below, portion 120 may implement four pieces of workout equipment, each with a different weight. Further, it should be appreciated that weighted objects similar to weighted objects 730 and 740 may be secured to portion 110, thereby enabling system 100 to implement nine pieces of workout equipment (e.g., with a total weight ranging from 6 lbs. to 20 lbs.) in one embodiment, each with a different weight.

TABLE 2

| Weights Applied to Portion 120 | Total Weight of Portion 120 (lbs) |
|---|---|
| None | 3 |
| 740 | 5 |
| 730 | 8 |
| 740 + 730 | 10 |

Weighted objects (e.g., 730, 740, etc.) used to adjust the weight of system 100 may be removed from respective portions to which they are secured and used apart from the portions in one embodiment. For example, weighted object 730 may be removed from portion 120 and used to perform exercises (e.g., hip adduction using weighted object 730 as a weighted ring hanging on the foot or leg) apart from portion 120. Additionally, weighted object 740 may be removed from portion 120 and used to perform exercises (e.g., wrist-strengthening exercises, etc.) apart from portion 120. As such, embodiments provide an increased number of pieces of exercise equipment which serve multiple purposes (e.g., using weighted object 730 to vary the weight of system 100 and also as a weighted ring), thereby increasing functionality of system 100 while reducing cost, floor space used while not in use, storage area required for system 100, etc.

Although FIGS. 7A and 7B depict only portion 120, it should be appreciated that weighted objects (e.g., 730, 740, etc.) may be secured to other portions of system 100 (e.g., portion 110) in other embodiments. Additionally, although specific shapes, sizes, etc. have been used in FIGS. 7A and 7B for components of system 100 (e.g., portion 120, weighted object 730, weighted object 740, etc.), it should be appreciated that one or more of the components may be alternatively shaped, sized, etc. in other embodiments. It should also be appreciated that system 100 may comprise a larger number of portions (e.g., in addition to portions 110 and 120) in other embodiments. Further, it should be appreciated that a smaller or larger number of weighted objects (e.g., 730, 740, etc.) may be used in other embodiments.

Figure 8A:
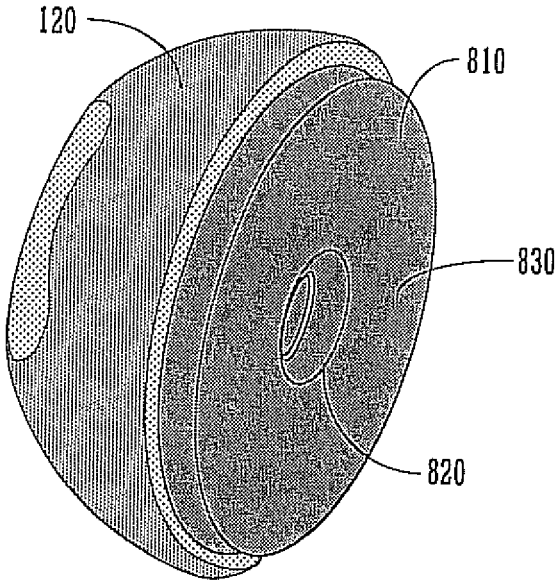
FIG. 8A shows an exemplary portion of a configurable exercise system with an exemplary additional component in accordance with one embodiment of the present invention.
Figure 8B:
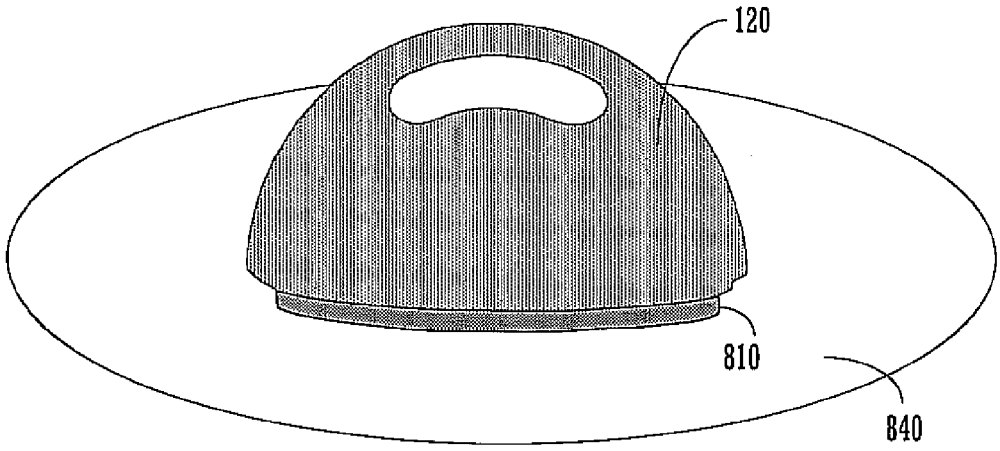
FIG. 8B shows an exemplary portion of a configurable exercise system with an exemplary additional component placed on a surface in accordance with one embodiment of the present invention.

FIGS. 8A and 8B show exemplary portion 120 of configurable exercise system 100 with exemplary additional component 810 in accordance with one or more embodiments of the present invention. Component 810 may be engaged and/or secured to portion 120 using engagement features of component 810 (not shown in FIGS. 8A and 8B) which interface with engagement features of portion 120 (e.g., 122, 124, 126, etc.). Additionally, component 810 may comprise one or more features and/or surfaces for interfacing with objects and/or surfaces. For example, feature 820 may comprise a cylindrical cavity in component 810 in one embodiment, where feature 820 may accept the end of a barbell for enabling portion 120 to be coupled with the barbell as a barbell weight.

Alternatively, feature 820 may accept and/or secure an additional component for making portion 120 unstable with respect to surface 840 on which it is placed. For example, feature 820 may accept a tennis ball or other spherical object for making portion 120 unsteady. Alternatively, a pillow or other object may be coupled with portion 120 via component 810 (e.g., engaging feature 820, engaging a feature of component 810 not depicted in FIG. 7A, etc.). And in other embodiments, features for making portion 120 unstable (e.g., spherical objects, pillows, etc.) may be formed as part of component 810. Accordingly, embodiments provide an exercise apparatus which may be used to increase muscular control, strength, etc. when using portion 120 as push-up bar or other piece of exercise equipment.

As shown in FIGS. 8A and 8B, surface 830 of component 810 may comprise a relatively low coefficient of friction for enabling portion 120 to slide across surface 840. Alternatively, another object or component with such a surface (e.g., comprising a relatively low coefficient of friction) may be coupled with portion 120 via component 810 (e.g., engaging feature 820, engaging a feature of component 810 not depicted in FIG. 7A, etc.). As such, portion 120 may implement a sliding handgrip in one embodiment.

As shown in FIG. 8A, surface 830 may also comprise a substantially flat surface for enabling a user to stand on portion 120. Although not depicted in FIG. 8A, surface 830 may comprise a larger surface area and extend beyond the outer diameter of portion 820 in one embodiment. Surface 830 may comprise texturing or other features to increase the grip of surface 830, thereby enabling a user to more easily stand on portion 120 (e.g., with handle 125 in contact with the ground) without the user's feet inadvertently slipping off of surface 830. In this manner, portion 120 may be used as a wobble board or similar workout apparatus for performing core training exercises or other exercises.

In another embodiment, surface 830 may also comprise a surface (e.g., a padded surface) for placement under a user's back while handle 125 and/or the outer surface of portion 120 is in contact with the ground. Surface 830 may rotate or rock with respect to the ground as the outer surface of portion 120 rolls along the ground. In this manner, portion 120 may be used to perform sit-ups or other abdominal exercises.

Figure 9:
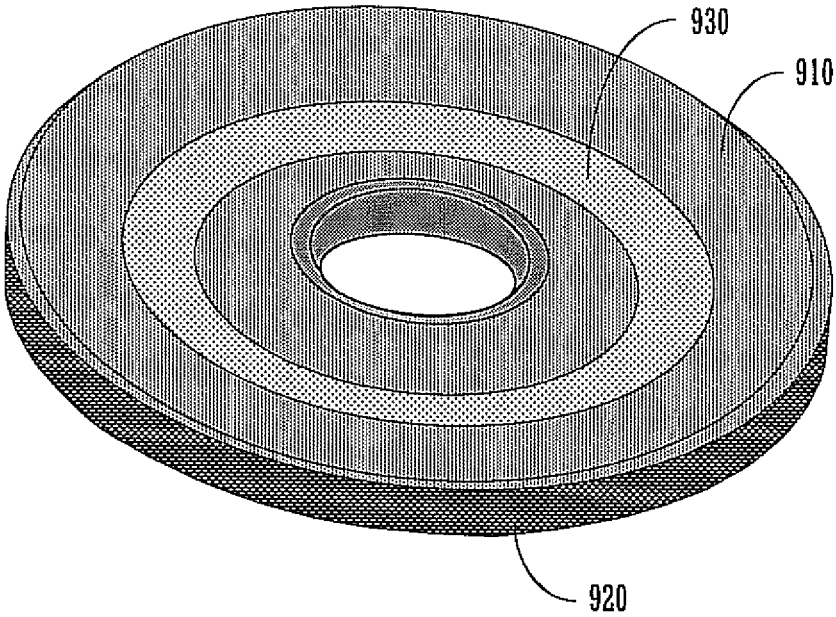
FIG. 9 shows an exemplary rotatable component for a portion of a configurable exercise system in accordance with one embodiment of the present invention.

Alternatively, component 810 may comprise a surface operable to rotate with respect to portion 120 as depicted in FIG. 9. As shown in FIG. 9, exemplary component 810 comprises top portion 910 (e.g., for engaging portion 120) which rotates independently of bottom portion 920 using bearing 930 disposed between top portion 910 and bottom portion 920. Accordingly, bottom portion 920 may rotate with respect to portion 120 (e.g., coupled with top portion 910), thereby enabling portion 120 to implement a rotational push-up bar with a handle (e.g., handle 125) which rotates with respect to surface 840 (e.g., on which portion 120 is placed).

Figure 10:
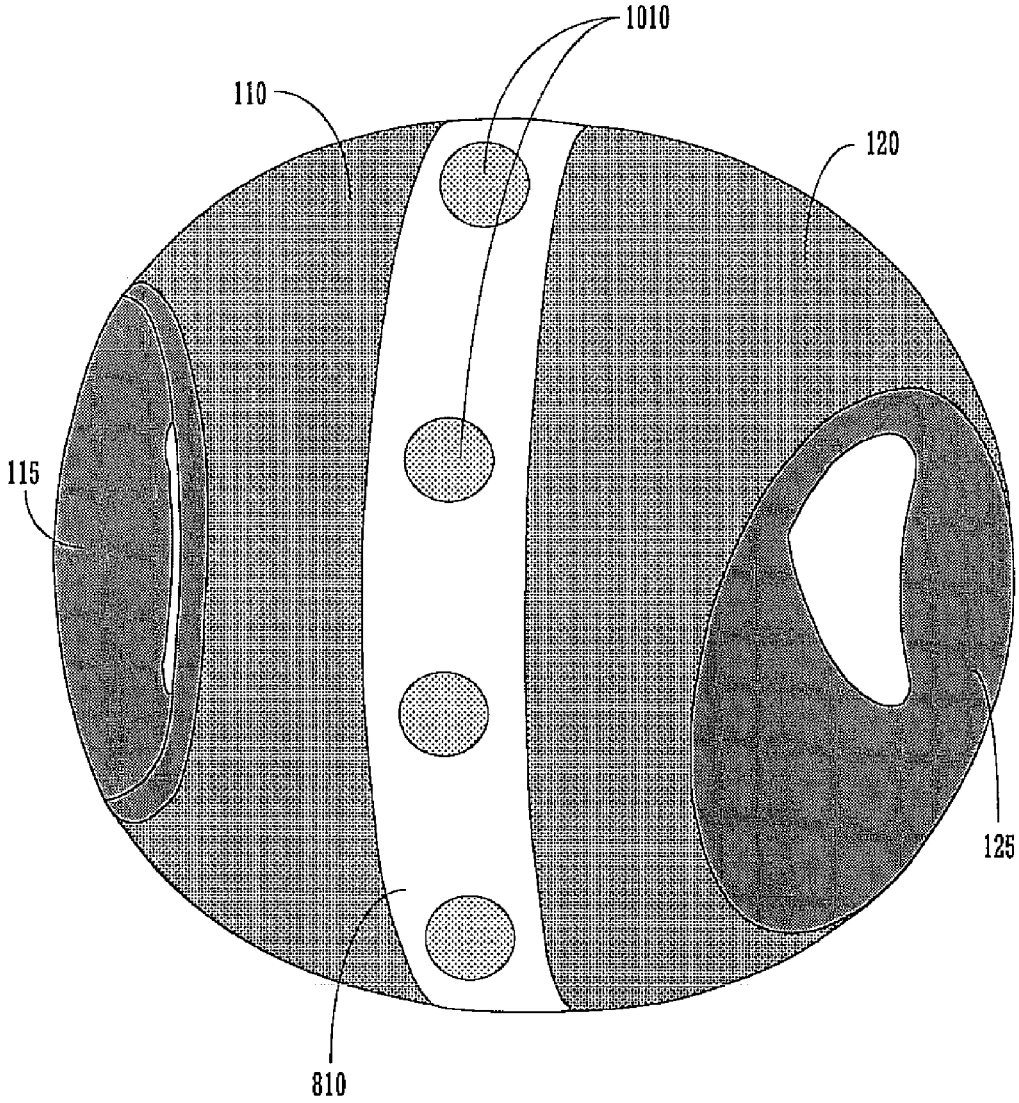
FIG. 10 shows an exemplary configurable exercise system with an exemplary circular portion operable to rotate with respect to portions of the configurable exercise system in accordance with one embodiment of the present invention.

FIG. 10 shows exemplary configurable exercise system 100 with an exemplary circular portion operable to rotate with respect to portions 110 and 120 in accordance with one embodiment of the present invention. As shown in FIG. 10, component 810 is disposed between portions 110 and 120 and comprises a surface operable to rotate independently of portion 110 (and handle 115) and portion 120 (and handle 125). Additionally, portion 810 comprises features 1010 for interfacing with a surface over which component 810 is rolled. In one embodiment, features 1010 may protrude from component 810, and may also comprise a relatively soft material (e.g., rubber, etc.) for gripping a surface over which component 810 is rolled. In this manner, handles 115 and 125 may be gripped and system 100 may be pushed to cause component 810 to roll over a surface, thereby enabling system 100 to be used for performing abdominal exercises and/or other exercises.

In one embodiment, component 810 as depicted in FIG. 10 may comprise with two bearings (e.g., similar to bearing 930 of FIG. 9) disposed on either side of a center portion (e.g., with a surface comprising features 1010). Additionally, component 810 may comprise two outer portions disposed on either side of the two bearings and for engaging portion 110 and 120, respectively. Accordingly, the center portion may rotate independently of the two outer portions coupled with portion 110 (and handle 115) and portion 120 (and handle 125).

Figure 11:
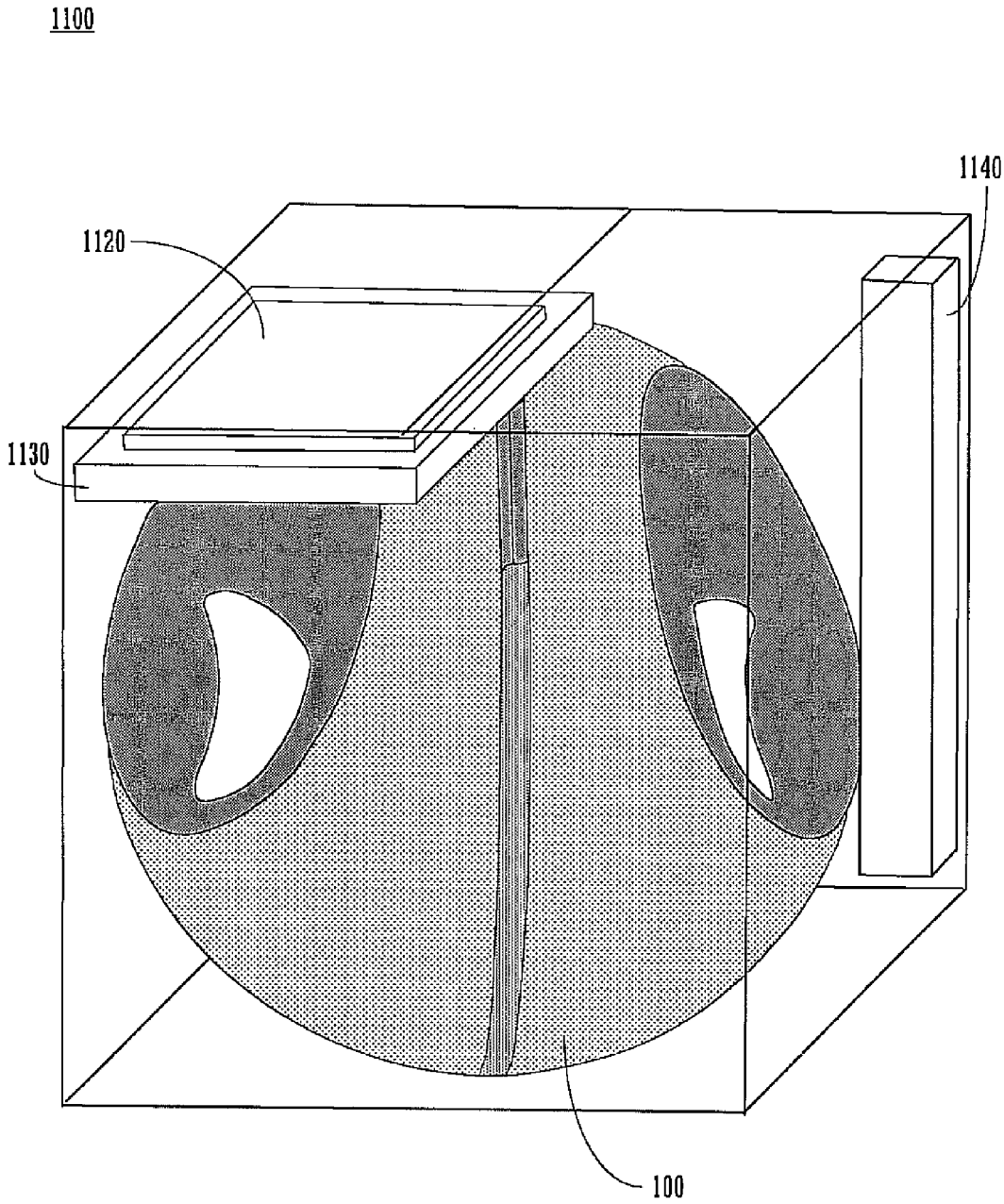
FIG. 11 shows an exemplary retail package for a configurable exercise system in accordance with one embodiment of the present invention.

FIG. 11 shows exemplary retail package 1100 for configurable exercise system 100 in accordance with one embodiment of the present invention. As shown in FIG. 11, system 100 is disposed within container 1110, where container 1110 may comprise cardboard, plastic, or other materials. Additionally, literature 1120 (e.g., a manual for system 100, information about system 100, etc.), video 1130 (e.g., showing how to use system 100), and carrying case 1140 may also be disposed within container 1110. Accordingly, container 1110 may be used for storing, displaying (e.g., in a retail store), or otherwise containing system 100 and/or various items (e.g., 1120-1140) related to system 100.

Although FIG. 11 shows specific items relating to system 100 disposed within container 1110, it should be appreciated that one or more of items 1120-1140 may be omitted in other embodiments. Additionally, it should be appreciated that package 1100 may comprise one or more other items (e.g., related to system 100, not related to system 100, etc.) not depicted in FIG. 11. Further, it should be appreciated that the items within container 1110 may be alternatively arranged in other embodiments.

Figure 12A:
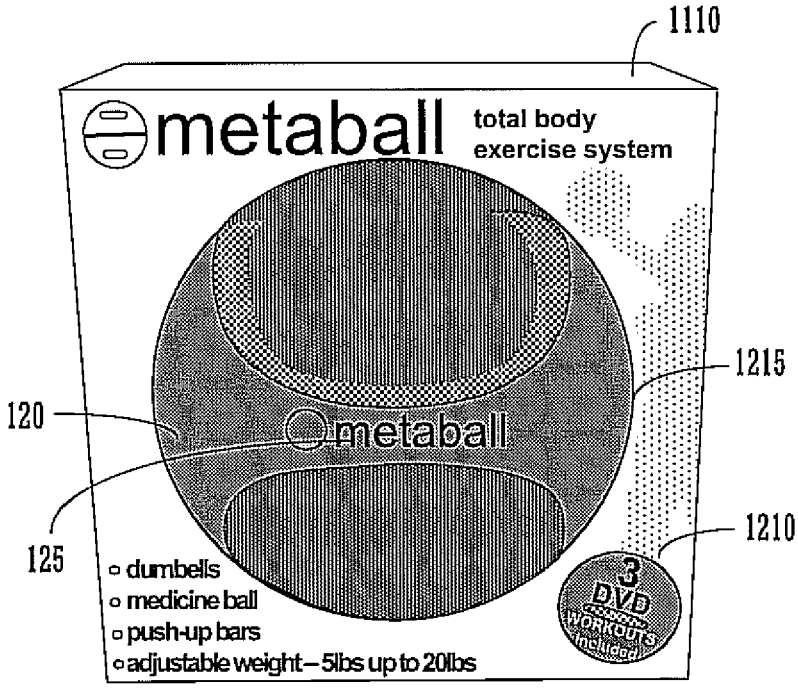
FIG. 12A shows a first view of an exemplary retail package in accordance with one embodiment of the present invention.

FIG. 12A shows a first view of exemplary retail package 1100 in accordance with one embodiment of the present invention. As shown in FIG. 12A, container 1110 comprises first surface 1210 with window 1215. Window 1215 may enable users to view and/or interact with (e.g., feel, handle, etc.) system 100 (e.g., portion 120 and handle 125). Additionally, surface 1210 may provide an area or region for displaying advertising information (e.g., using retail package to communicate information to potential purchasers), information about system 100, or the like.

Figure 12B:
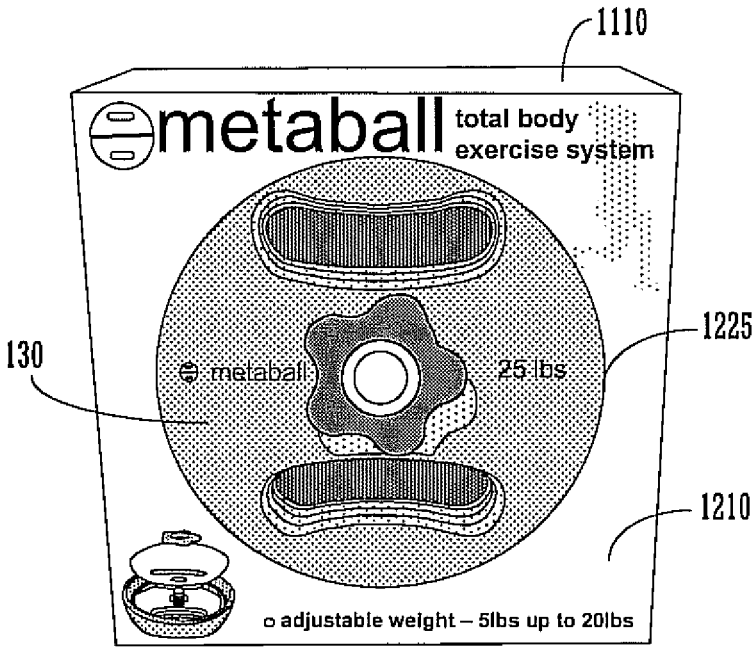
FIG. 12B shows a second view of an exemplary retail package in accordance with one embodiment of the present invention.

FIG. 12B shows a second view of exemplary retail package 1100 in accordance with one embodiment of the present invention. As shown in FIG. 12B, container 1110 comprises second surface 1220 with window 1225. Window 1225 may enable users to view and/or interact with (e.g., feel, handle, etc.) system 100 (e.g., weighted object 130). Additionally, surface 1220 may provide an area or region for displaying advertising information (e.g., using retail package to communicate information to potential purchasers), information about system 100, or the like.

In the foregoing specification, embodiments of the invention have been described with reference to numerous specific details that may vary from implementation to implementation. Thus, the sole and exclusive indicator of what is, and is intended by the applicant to be, the invention is the set of claims that issue from this application, in the specific form in which such claims issue, including any subsequent correction. Hence, no limitation, element, property, feature, advantage, or attribute that is not expressly recited in a claim should limit the scope of such claim in any way. Accordingly, the specification and drawings are to be regarded in an illustrative rather than a restrictive sense.

What is claimed is:

1. A configurable exercise system comprising:

a spherical-shaped housing operable to implement a first piece of workout equipment, wherein said housing comprises:

a first portion comprising a first feature, wherein said first feature extends from a first surface and is operable to secure a first object within said first portion, and wherein said first portion defines a first opening forming a first handle; and a second portion operable to physically couple with said first portion, wherein said second portion comprises a second feature, wherein said second feature extends from a second surface and is operable to secure a second object within said second portion, and wherein said second portion defines a second opening forming a second handle; and wherein said first and second portions are operable to be disengaged from one another to implement a second piece of workout equipment and a third piece of workout equipment.

2. The configurable exercise system of claim 1, wherein said first feature is a first threaded post, and wherein said second feature is a second threaded post.

3. The configurable exercise system of claim 1, wherein said first feature comprises a first fastening material, and wherein said second feature comprises a second fastening material.

4. The configurable exercise system of claim 1, wherein said first object is selected from a group consisting of a shot-filled object, a sand-filled object, a water-filled object, a metal object, and a weight plate, and wherein said second object is selected from a group consisting of a shot-filled object, a sand-filled object, a water-filled object, a metal object, and a weight plate.

5. The configurable exercise system of claim 1, wherein said first piece of workout equipment is a medicine ball, and wherein said second and third pieces of workout equipment are selected from a group consisting of at least one dumbbell, at least one kettlebell, at least one push-up bar, at least one rotational push-up bar, at least one weight for a barbell, at least one handle for an elastic band, and at least one sliding handgrip.

6. The configurable exercise system of claim 1, wherein said first portion and said second portion each comprise analogous engagement features operable to physically couple said first portion to said second portion.

7. A workout apparatus comprising:

a housing defining an opening forming a handle, wherein said housing resembles a hemi-sphere with a circular base, and wherein said housing comprises a first feature disposed at said circular base; and an additional component comprising a second feature, wherein said second feature is operable to engage said first feature to attach said additional component to said housing.

8. The workout apparatus of claim 7, wherein said housing is operable to be disengaged from said additional component and used as a first type of exercise equipment, and wherein said additional component and said housing are operable to be secured to one another to implement a second type of exercise equipment.

9. The workout apparatus of claim 7, wherein said additional component comprises a rotating surface operable to rotate independently of said housing, and wherein said housing and said additional component are operable to implement a rotational push-up bar.

10. The workout apparatus of claim 7, wherein said additional component is selected from a group consisting of a pillow, a component with a spherical-shaped surface, and a component with a substantially flat surface.

11. The workout apparatus of claim 7, wherein said additional component comprises a first surface for sliding over a second surface, and wherein said housing and said additional component are operable to implement a sliding handgrip.

12. The workout apparatus of claim 7, wherein said housing further comprises a third feature operable to secure at least one object to said housing.

13. The workout apparatus of claim 12, wherein said third feature is further operable to secure said at least one object within said housing.

14. The workout apparatus of claim 12, wherein said third feature is a threaded post.

15. The workout apparatus of claim 12, wherein said third feature comprises a fastening material.

16. The workout apparatus of claim 12, wherein said at least one object is selected from a group consisting of a shot-filled object, a sand-filled object, a water-filled object, a metal object, and a weight plate.

17. An exercise apparatus comprising:

a first portion comprising a first handle and a first feature, wherein said first feature extends from a first surface and is operable to interface with a first plurality of objects disposed within said first portion; and a second portion operable to physically couple with said first portion, wherein said second portion comprises a second handle and a second feature, wherein said second feature extends from a second surface and is operable to interface with a second plurality of objects disposed within said second portion; and a third portion operable to engage said first portion to said second portion, wherein said third portion is further operable to enable said first and second portions to rotate independently of one another.

18. The exercise apparatus of claim 17, wherein said third portion is disposed between said first and second portions and further operable to roll along a surface responsive to pushing of said exercise apparatus using said first and second handles.

19. The exercise apparatus of claim 17, wherein said first and second portions are operable to disengage from said third portion.

20. The exercise apparatus of claim 17, wherein said first portion comprises a first engagement feature, wherein said second portion comprises a second engagement feature, and wherein said first and second engagement features are operable to couple said first and second portions directly to one another.

21. The exercise apparatus of claim 17, wherein said first and second portions are operable to be engaged to implement a first piece of workout equipment, and wherein said first and second portions are operable to be disengaged to implement a second piece of workout equipment and a third piece of workout equipment.

22. The exercise apparatus of claim 17, wherein said first feature is a first threaded post, and wherein said second feature is a second threaded post.

23. The exercise apparatus of claim 17, wherein said first feature comprises a first fastening material, and wherein said second feature comprises a second fastening material.

24. The exercise apparatus of claim 17, wherein said first plurality of objects is operable to adjust the weight of said first portion, and wherein said second plurality of objects is operable to adjust the weight of said second portion.

25. The exercise apparatus of claim 17, wherein said first plurality of objects is selected from a group consisting of at least one shot-filled object, at least one sand-filled object, at least one water-filled object, at least one metal object, and at least one weight plate, and wherein said second plurality of objects is selected from a group consisting of at least one shot-filled object, at least one sand-filled object, at least one water-filled object, at least one metal object, and at least one weight plate.

* * * * *